United States Patent [19]

Naylor

[11] Patent Number: 4,524,022

[45] Date of Patent: Jun. 18, 1985

[54] DICYCLOPENTADIENE SULFONATE LIQUID DETERGENT FORMULATIONS

[75] Inventor: Carter G. Naylor, Austin, Tex.

[73] Assignee: Texaco Inc., White Plains, N.Y.

[21] Appl. No.: 548,538

[22] Filed: Nov. 3, 1983

[51] Int. Cl.[3] ..... C11D 1/12; C11D 1/831; C11D 3/44

[52] U.S. Cl. ..... 252/548; 252/174.21; 252/529; 252/531; 252/532; 252/536; 252/538; 252/539; 252/549; 252/550; 252/551; 252/558; 252/559; 252/DIG. 14; 252/530

[58] Field of Search ..... 252/549, 558, 174.21, 252/DIG. 14, 550, 551; 260/503

[56] References Cited

U.S. PATENT DOCUMENTS

| | | | |
|---|---|---|---|
| 3,370,080 | 2/1968 | Bloch | 252/549 X |
| 4,284,532 | 8/1981 | Leikhim et al. | 252/528 |
| 4,436,653 | 3/1984 | Jacobsen et al. | 252/547 |
| 4,438,002 | 3/1984 | Schievelbein et al. | 252/8.55 D |

*Primary Examiner*—Prince E. Willis

*Attorney, Agent, or Firm*—Richard A. Morgan; Jack H. Park; Kenneth R. Priem

[57] ABSTRACT

Dicyclopentadiene sulfonate has been found to possess useful properties in liquid detergent formulations. The composition itself is not surface active, but it is an efficient hydrotrope for surface active agent compositions. It increases phase stability, reduces viscosity and prevent gelling of concentrated surfactant blends.

13 Claims, No Drawings

DICYCLOPENTADIENE SULFONATE LIQUID DETERGENT FORMULATIONS

BACKGROUND OF THE INVENTION

1. Field of the Invention

This invention relates to liquid detergent formulations comprising a dicyclopentadiene derivative as a hydrotrope. These formulations are useful for household, institutional and industrial cleaning applications.

2. Description of Related Art

Hydrotropes are chemical compounds which are used in liquid detergent formulations to increase the aqueous solubility of slightly soluble substituents in the formulation. Hydrotropes lower the viscosity and gelling tendency of concentrated liquid detergent blends and improve their stability. They can also enhance the effectiveness of the surfactants in the formulation. The most widely used hydrotrope is sodium xylene sulfonate.

This application is related to application Ser. No. 06/420,203 filed Sept. 20, 1982, now U.S. Pat. No. 4,454,074. This related application teaches a method for preparing salts of dicyclopentadiene sulfonate. Application Ser. No. 06/420,430 filed Sept. 20, 1982, now U.S. Pat. No. 4,438,002 teaches the use of sulfonated dicyclopentadiene in the recovery of hydrocarbons from underground formations.

SUMMARY OF THE INVENTION

The present invention is a highly concentrated liquid detergent composition comprising:

(a) about 25 wt. % to about 50 wt. % of a surface active agent comprising:
  (i) a nonionic surfactant in the amount of about 20 wt. % to about 40 wt. %, and
  (ii) an anionic surfactant in the amount of about 0 wt. % to about 20 wt. %;
(b) about 0 wt. % to about 10 wt. % of a solvent selected from the group consisting of ethanol, isopropanol and mixtures thereof;
(c) a hydrotrope selected from the group consisting of the ammonium, sodium, potassium, calcium and magnesium salts of dicyclopentadiene sulfonate in an amount sufficient to give the liquid detergent a kinematic viscosity of from 50 to 500 cs at 25° C.; and
(d) water.

The hydrotrope is not surface active itself. The hydrotrope increases phase stability, reduces viscosity and prevents gelling of the concentrated surfactant blend.

DESCRIPTION OF THE PREFERRED EMBODIMENTS

The present invention in one embodiment is a highly concentrated liquid detergent composition comprising:

(a) about 25 wt. % to about 50 wt. %; preferably 35 wt. % to 45 wt. %, of a surface active agent comprising:
  (i) a nonionic surfactant in the amount of about 20 wt. % to about 40 wt. %; preferably 25 wt. % to 35 wt. %, and
  (ii) an anionic surfactant in the amount of about 0 wt. % to about 20 wt. %; preferably 5 wt. % to 15 wt. %;
(b) about 0 wt. % to about 10 wt. %; preferably 2 wt. % to 6 wt. %, of a solvent selected from the group consisting of ethanol, isopropanol and mixtures thereof;

(c) a hydrotrope selected from the group consisting of the ammonium, sodium, potassium, calcium and magnesium salts of dicyclopentadiene sulfonate in an amount sufficient to give the highly concentrated liquid detergent a kinematic viscosity of from 50 to 500 cs, preferably from 100 to 250 cs at 25° C.; and
(d) water.

Compositions of the present invention are useful as cleaning agents for household, institutional and industrial applications. The hydrotrope can be used as a co-surfactant, allowing less surfactant to be used without loss of performance.

Dicyclopentadiene sulfonate has been found to be more effective than conventional hydrotropes in liquid detergent formulations. Its superiority is demonstrated in the examples. The composition and properties of this compound have been found to be dependent on the conditions of its manufacture. This phenomenon is illustrated in Example 2.

Hydrotropes of the present invention are believed to be a mixture of two compounds having the following structures:

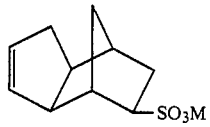

(1)

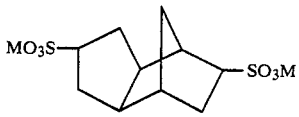

(2)

Structure (1) is predominant. Both structures represent numerous positional and optical isomers, all of which may be present in the compositions prepared according to the present invention. The sulfonates may also contain sulfinate groups adjacent to the sulfonate groups.

Dicyclopentadiene is the Diels-Alder dimer of 1,3-cyclopentadiene, a component of $C_5$ streams of ethylene producing naphtha crackers. When separated from ethylene plant $C_5$ streams, dicyclopentadiene is frequently contaminated with other $C_{10}$ to $C_{12}$ cyclic olefins which are difficult to separate. The present invention; however, may be practiced with dicyclopentadiene that is from about 50% to 100% pure. Thus, hydrocarbon streams rich in dicyclopentadiene may be used in the formulations of the present invention.

The preferred method of making dicyclopentadiene sulfonate salts is by bisulfite addition to dicyclopentadiene. Dicyclopentadiene is placed in a reaction medium of alcohol and water and a small quantity of hydroxide is added. The pH of the reaction mixture is then adjusted to a predetermined pH, preferably between about 5.5 and about 8.0, and the mixture is heated to about 30° C. to about 70° C., preferably 55° C. Bisulfite is then slowly added to the reaction mixture at such a rate as to maintain the preselected pH while concurrently adding oxygen to the reaction mixture. Bisulfite addition should be slow and occur over a period of about 1 to about 24 hours, preferably about 1 to about 8 hours. The relative amounts of structure(1) and structure(2) as well as sulfonate-sulfinate compounds is determined by the pH and stoichiometry of bisulfite addition.

After bisulfite addition has been terminated, the alcoholic solvent is removed by distillation and replaced with water. The dicyclopentadiene sulfonate salts are then available for use in an aqueous solution. Alternatively, the dicyclopentadiene sulfonate salts may be removed from solution by filtration.

It is preferred that a small quantity of an alkali metal hydroxide or ammonium hydroxide be added to the aqueous alcohol medium prior to adjusting the pH of the reaction mixture. The hydroxide added should have the same cation as the cation of the desired dicyclopentadiene sulfonate salt. Sodium hydroxide and ammonium hydroxide are the preferred hydroxide additives just as the sodium and ammonium salts of dicyclopentadiene sulfonate are the preferred products.

It is recommended that the alkanol employed to create the aqueous alcoholic reaction medium be a low molecular weight alcohol such as methanol, ethanol, propanol, isopropanol, butanol or isobutanol. Isopropanol is especially preferred.

The bisulfite added to the reaction mixture is selected from the group consisting of sodium bisulfite, potassium bisulfite, calcium bisulfite, magnesium bisulfite or ammonium bisulfite. The bisulfite added supplies the cation of the desired dicyclopentadiene sulfonate salt. The concurrent addition of oxygen or air provides oxygen for the initiation of the bisulfite reaction. Bubbling oxygen through the reaction medium is the preferred means of addition. The rate of flow of the air or oxygen added is not critical to the process.

It has been discovered that the pH at which the bisulfite reaction takes place is critical to the proportion of monosulfonates, disulfonates and sulfinates in the final product. The proportions of monosulfonates to disulfonates, and sulfonates to sulfinates change considerably at different reaction medium pH within the suggested pH range of about 5.5 to about 8.0 for the bisulfite reaction. For example, bisulfite reaction conducted according to the process of the invention at a pH of about 7.2 yields about 80% to 85% monosulfonates in the final product; and total sulfur incorporated per mole of dicyclopentadiene is 1.11. But when the reaction pH is changed to about 6.0, total sulfur incorporated increases to 1.65 equivalents per mole of dicyclopentadiene.

The anionic surfactant chosen is not critical and may be any of the known anionic surfactants used and is chosen on the basis of effectiveness and economy. These anionic surfactants include any of the known hydrotropes attached to a carboxylate, sulfonate, sulfate or phosphate polar, solubilizing group including salts. Salts may be the sodium, potassium, calcium, magnesium, barium, iron, ammonium and amine salts.

Suitable hydrophobes are 10 to 18 carbon number alkyls, particularly linear and essentially linear alkyls. Additionally, alkylaryls, ethoxylated alkyls, alkylpolyoxyalkylenes, alkyarylpolyoxyalkenes and alkylenes of 10 to 18, preferably 12 to 15 carbon atoms are suitable hydrophobes.

A preferred class of anionic surfactants is the sulfates and sulfonates such as alkyl sulfates, alkylaryl sulfates, ethoxylated alkyl or alkylarylsulfates, alkylarylsulfonates, alkylarylpolyoxyalkylenesulfonates and petroleum sulfonates.

A short list of examples of alkylarylsulfonates is dodecylbenzene sulfonate, sodium tribenzyl sulfonate, undecylbenzene sulfonate, tridecylbenzene sulfonate, nonylbenzene sulfonate, the sodium, potassium, ammonium, triethanolammonium and isopropylammonium salts thereof.

The various materials available under the general name of petroleum sulfonates vary in composition according to the petroleum fraction used for sulfonation and in the degree of sulfonation imparted to the petroleum fraction. Preferable petroleum sulfonates are those prepared from a petroleum fraction whose boiling range is from 700° F. to 1100° F. which corresponds to a molecular weight range of from about 350 to about 500. The sodium salt of the sulfonated product of this petroleum fraction is an excellent material for use in the present invention. The potassium and ammonium salts are also useful.

Mixtures of petroleum sulfonates can also be employed. For example, a mixture of predominantly water soluble petroleum sulfonate having an average equivalent weight of less than 400 and preferably less than 350 may be utilized along with a second petroleum sulfonate which is at least partially oil soluble and having an average equivalent weight of about 400 to about 600 and preferably about 450 to about 550.

The nonionic surfactant chosen is not critical and may be any of the known surfactants compatible with the anionic surfactant chosen. These are preferably the 10 to 18, preferably 12 to 15 carbon number nonionic surfactants. These include alcohol alkoxylates, alkylphenol alkoxylates, carboxylic acid esters, polyoxyalkylene esters, particularly the ethoxy, propoxy and ethoxy-propoxy adducts thereof. Examples include but are not limited to alcohol ethoxylates; i.e. ethoxylated aliphatic alcohols, alkylphenols; i.e. ethoxylated alkyl phenols such as the 8.5 molar ethoxylate of nonylphenol.

The anionic-nonionic surfactant pair is selected on the basis of compatibility and the application. The method for determining the optimum surfactant concentration is found in U.S. Pat. No. 4,066,124 which is incorporated herein in its entirety by reference. The ratio of nonionic:anionic surfactant ranges from 100:1 to 1:100 with nonionic surfactant of greater than half being preferred. Total anionic and nonionic surfactant is preferably 25 wt. % to 50 wt. % , most preferably 35 wt. % to 45 wt. %.

It has been found that the only satisfactory method for determining the proper contributions of hydrotrope and solvent involves actually preparing a series of solutions containing the materials in various concentrations and determining the ratio of solvent to hydrotrope which produces the desired properties of viscosity and cloud point.

As a starting point, at least 3 and preferably 5 different solvent-hydrotrope samples should be prepared for each anionic-nonionic surfactant blend and concentration. Solvent is added to each sample in an amount such that series of samples spans the range of from 2 wt. % to 6 wt. % of solvent. If this starting procedure is not successful, it may be rerun to cover the range of 0 wt. % to 10 wt. % solvent. Then an aliquot of hydrotrope is added to each sample, in an amount that is determined by experience. As a first try, with no other information available, 2 wt. % of hydrotrope may be tried.

The desirable economic goal would be to have no solvent and all hydrotrope to achieve kinematic viscosity of 50 to 500 preferably 100 to 250 cs @ 25° C. However, typically, some solvent must be added to achieve this viscosity range with a clear point if desired of no higher than 10° C.

The clear point of each sample is determined and in a subsequent set of samples solvent minimized and hydrotrope added to give a kinematic viscosity of 50 to 500 preferably 100 to 250 cs @ 25° C. at the desired clear point (typically but not invariably 10° C.). The term clear point is known in the art as a measure of the relative compatibility of detergent compounds and is the temperature at which turbidity disappears as the formulation is warmed or heated from a cooler temperature.

The final composition is compounded by methods well known in the art.

The concentrated composition is typically shipped to point of use and then further diluted with water and if desired, cleaning adjuvants. Desired dilution for end use strength is typically 0.1 vol. % concentrated formulation in water. This concentration gives rise to a preferred actual range of about 0.05 vol. % to about 0.5 vol. %.

In this end use strength, the invention is:

a dilute liquid detergent composition comprising:

A. about 0.01 vol. % to about 50 vol. % of a concentrated liquid detergent formulation comprising:

(a) about 25 wt. % to about 50 wt. % of a surface active agent comprising:

(i) a nonionic surfactant and (ii) an anionic surfactant wherein the weight ratio of anionic:nonionic is 0:1 to 2:1;

(b) about 0 wt. % to about 10 wt. % of a solvent selected from the group consisting of ethanol, isopropanol and mixtures thereof;

(c) a hydrotrope selected from the group consisting of the ammonium, sodium, potassium, calcium and magnesium salts of dicyclopentadiene sulfonate in an amount of from 1 wt. % to 6 wt. %; and B. water.

The dilute liquid detergent is most conveniently made by first compounding the concentrated composition and then diluting it with water. The method of formulation of the concentrate most effectively gives the best balance between solvent and hydrotrope and solvent, minimizing solvent. The kinematic viscosity testing hereinbefore described yields a solvent concentration of about 0 wt. % to about 10 wt. %; preferably 2 wt. % to 6 wt. % based on the concentrate, proportionately reduced in the dilute composition. This testing also yields a hydrotrope concentration of 1 wt. % to 6 wt. % based on the concentrate, proportionately reduced in the dilute composition.

The weight percents of anionic and nonionic surfactant correspond to weight ratios of 0:1 to 2:1 anionic:nonionic in the concentrate, proportionately reduced in the dilute composition. These guidelines may be used to formulate the dilute composition directly. However, it is anticipated that best and most economic result will be achieved by the formulation of the concentrate and dilution to 0.1 vol. % with water and optionally cleaning adjuvants.

The following classes of materials are generically referred to as detergent adjuvants:

1. Inorganic salts, acids and bases. These are usually referred to as "builders". These salts usually comprise carbonates, hydroxides, phosphates and silicates of the alkali metals as well as their neutral soluble salts. These materials may constitute up to about 99 weight percent of the composition in which they are employed.

2. Organic builders or additives—These are substances which contribute to characteristics such as detergency, foaming power, emulsifying power or soil-suspending effect. Typical organic builders include sodium carboxymethyl cellulose, sequestering agents such as ethylenediaminetetraacetic acid and the fatty monoethanolamides, etc.

3. Special purpose additives—These include solubilizing additives such as lower alcohols, glycols and glycol ethers, bleaches or brighteners of various structures which share in common that they are dyestuffs and they do not absorb or reflect light in the visible range of the spectrum.

EXAMPLE 1

A one-liter three-neck flask was charged with 100 grams of dicyclopentadiene (95% grade), 200 grams of isopropyl alcohol, 100 grams of water and 14 grams of 20% sodium hydroxide. A 33.3 weight percent sodium metabisulfite ($Na_2S_2O_5$) aqueous solution was added to adjust the pH to 7.2. After heating the reaction mixture of 55° C., air was bubbled in at 30 milliliters per minute. Concurrently, sodium bisulfite was slowly added at a rate sufficient to maintain the pH of the reaction mixture at 6.5. After 288 grams of the 33.3 weight percent sodium bisulfite solution had been added, uptake ceased. Elapsed time of bisulfite addition was 2.3 hours.

The aqueous dicyclopentadiene sulfonate (DCPD-S) solution contained 15.7 wt. % sulfur on a 100% active basis, corresponding to 1.32 equivalents of sulfur per mole of dicyclopentadiene. This product is referred to as preparation 1.

Additional preparations of DCPD-S were made according to this procedure at differing pH. All results are summarized herein:

TABLE 1

DCPD—S PREPARATIONS

| Preparation | Prep. pH | Wt % S | Equiv. S/(Mol DCPD) |
|---|---|---|---|
| 1 | 6.5 | 15.7 | 1.32 |
| 2 | 6.0 | 17.4 | 1.65 |
| 3 | 6.4 | 17.0 | 1.55 |
| 4 | 6.8 | 15.9 | 1.36 |
| 5 | 7.2 | 14.3 | 1.11 |
| 6 | 7.6 | 14.5 | 1.13 |

Liquid heavy duty detergent formulations were prepared from SURFONIC® N-85 (nonylphenol +8.5 moles ethylene oxide), sodium dodecylbenzene sulfonate ($C_{12}$LAS, Conoco SA-597, neutralized), triethanolamine (TEA) and hydrotropes. Viscosities and clear points (temperature at which solutions become clear as they are warmed) are tabulated below:

TABLE 2

DCPD—S HYDROTROPIC EFFECTS

| Formulation | Wt % N-85 | Wt % $C_{12}$LAS | Wt % TEA | Wt % Ethanol | Wt % DCPD—S (Prep 1) | Wt % SXS |
|---|---|---|---|---|---|---|
| A | 30 | 20 | 5 | 6 | 0 | 0 |
| B | 30 | 20 | 5 | 6 | 2 | 0 |
| C | 30 | 20 | 5 | 6 | 0 | 2 |
| D | 25 | 20 | 5 | 6 | 0 | 0 |
| E | 25 | 20 | 5 | 6 | 2 | 0 |
| F | 25 | 20 | 5 | 6 | 0 | 2 |
| G | 35 | 20 | 5 | 6 | 0 | 0 |
| H | 35 | 20 | 5 | 6 | 2 | 0 |
| I | 35 | 20 | 5 | 6 | 0 | 2 |

| Formulation | Viscosity, cs @ 25° C. | Clear Point, °C. |
|---|---|---|

TABLE 2-continued

| DCPD—S HYDROTROPIC EFFECTS | | |
|---|---|---|
| A | 150 | 11 |
| B | 130 | 21 |
| C | 135 | 20 |
| D | 138 | 5 |
| E | 115 | 14 |
| F | 115 | 15 |
| G | 157 | 24 |
| H | 138 | 27 |
| I | 128 | 29 |

The data demonstrate the hydrotropic effects of DCPD-S. There is no significant difference in behavior between DCPD-S and sodium xylene sulfonate (SXS) in these particular blends.

hydrotrope likewise is surpassed in effectiveness by one or more DCPD-S samples in each formulation. KCl is the least satisfactory of the hydrotropes tested, showing high clear points (i.e. low compatibility) in K and L series formulations. SURFONIC® HDL is a 6:1 (wt:wt) blend of SURFONIC® N-85 and triethanolamine

| Formulation Series | Wt. % SURFONIC ® HDL | Wt % $C_{12}$LAS | Wt % Total Actives |
|---|---|---|---|
| J | 25 | 5 | 30 |
| K | 30 | 10 | 40 |
| L | 35 | 15 | 50 |

TABLE 3

DCPD—S COMPOSITIONS

| Formulation | Wt % SURFONIC ® HDL | Wt % $C_{12}$LAS | Wt %* Hydrotrope | Example 1 DCPD—S Prep-pH | Kinematic Vis @ 25° C. cs | Clear pt, °C. |
|---|---|---|---|---|---|---|
| J-1 | 25 | 5 | — | — | 308 | ≦−10 |
| K-1 | 30 | 10 | — | — | 326 | ≦−10 |
| L-1 | 35 | 15 | — | — | 250 | 12 |
| J-2 | 25 | 5 | 2% EtOH | — | 170 | ≦−10 |
| K-2 | 30 | 10 | 2% EtOH | — | 212 | ≦−10 |
| L-2 | 35 | 15 | 2% EtOH | — | 176 | 0 |
| J-3 | 25 | 5 | 2% DCPD—S | 6.0 | 198 | ≦−10 |
| K-3 | 30 | 10 | 2% DCPD—S | 6.0 | 195 | ≦−10 |
| L-3 | 35 | 15 | 2% DCPD—S | 6.0 | 172 | 13 |
| J-4 | 25 | 5 | 2% DCPD—S | 6.4 | 183 | ≦−10 |
| K-4 | 30 | 10 | 2% DCPD—S | 6.4 | 210 | ≦−10 |
| L-4 | 35 | 15 | 2% DCPD—S | 6.4 | 184 | 10 |
| J-5 | 25 | 5 | 2% DCPD—S | 6.8 | 158 | ≦−10 |
| K-5 | 30 | 10 | 2% DCPD—S | 6.8 | 214 | ≦−10 |
| L-5 | 35 | 15 | 2% DCPD—S | 6.8 | 188 | 7 |
| J-6 | 25 | 5 | 2% DCPD—S | 7.2 | 145 | ≦−10 |
| K-6 | 30 | 10 | 2% DCPD—S | 7.2 | 262 | ≦−10 |
| L-6 | 35 | 15 | 2% DCPD—S | 7.2 | 200 | 4 |
| J-7 | 25 | 5 | 2% DCPD—S | 7.6 | 166 | ≦−10 |
| K-7 | 30 | 10 | 2% DCPD—S | 7.6 | 217 | ≦−10 |
| L-7 | 35 | 15 | 2% DCPD—S | 7.6 | 192 | 6 |
| J-8 | 25 | 5 | 2% SXS | — | 266 | ≦−10 |
| K-8 | 30 | 10 | 2% SXS | — | 491 | ≦−10 |
| L-8 | 35 | 15 | 2% SXS | — | 389 | 2 |
| J-9 | 25 | 5 | 2% KCl | — | 362 | ≦−10 |
| K-9 | 30 | 10 | 2% KCl | — | 280 | 9 |
| L-9 | 35 | 15 | 2% KCl | — | 1085** | 31 |

*All formulation contained 4 wt % EtOH.
"Wt % Hydrotrope" is in addition to 4 wt % EtOH.
J-1, K-1 and L-1 each contain 4 wt % EtOH
J-2, K-2 and L-2 each contain a total of 6 wt % EtOH.
**partial gel

EXAMPLE 2

The accompanying table (TABLE 3) illustrates the hydrotropic effects of DCPD-S compositions of Example 1 compared with those of ethanol, sodium xylene sulfonate (SXS) and KCl.

Among the DCPD-S samples, there is a surprising dependency of hydrotrope efficiency on the pH of synthesis. The pH 7.2 sample (Example 1 prep. 5) is the most efficient in the formulation J series (J-1, J-2... J-9) and the least efficient in the for the formulation K and L series. Conversely, the pH 6.0 sample (Example 1 prep. 2) is the least effective in the J series and the most effective in the K and L series. Clear points of the L series vary, preparation 5 of Example 1 (pH 7.2) giving the lowest clear point.

In the series K and L, all but one DCPD-S sample gave lower viscosities than SXS. Ethanol as the sole

EXAMPLE 3

The same formulations as used in Example 1 (Table 2) were prepared without ethanol, but with a 4 wt. % sulfonate hydrotrope. Kinematic viscosity and clear point data are summarized in Table 4. This data demonstrates that the preparation pH of dicyclopentadiene sulfonate strongly affects its properties.

Formulation series J (30 wt. % actives) viscosity is most effectively lowered by SXS (J-15), followed by dicyclopentadiene sulfonate of pH 7.2 (J-13). For series K (40 wt. % actives) dicyclopentadiene of pH 6.4 (K-11) is most effective while maintaining a satisfactory clear point. None of the dicyclopentadiene sulfonate preparations of series L showed adequate compatibility.

This data shows that the amount of alcohol cosolvent may go to 0 wt. % for the compositions to still retain satisfactory physical properties.

TABLE 4

DICYCLOPENTADIENE SULFONATE COMPOSITIONS WITHOUT ETHANOL

| Formulation | Wt % SURFONIC ® HDL | Wt % $C_{12}$LAS | Wt % Hydrotrope | Example 1 DCPD—S Prep-pH | Kinematic Vis @ 25° C. cs | Clear pt, °C. |
|---|---|---|---|---|---|---|
| J-10 | 25 | 5 | 4% DCPD—S | 6.0 | 293 | ≦−10 |
| K-10 | 30 | 10 | 4% DCPD—S | 6.0 | 246 | 17 |
| L-10 | 35 | 15 | 4% DCPD—S | 6.0 | — | >40 |
| J-11 | 25 | 5 | 4% DCPD—S | 6.4 | 328 | ≦−10 |
| K-11 | 30 | 10 | 4% DCPD—S | 6.4 | 272 | 3 |
| L-11 | 35 | 15 | 4% DCPD—S | 6.4 | — | >40 |
| J-12 | 25 | 5 | 4% DCPD—S | 6.8 | 269 | ≦−10 |
| K-12 | 30 | 10 | 4% DCPD—S | 6.8 | 323 | ≦−10 |
| L-12 | 35 | 15 | 4% DCPD—S | 6.8 | 313 | 23 |
| J-13 | 25 | 5 | 4% DCPD—S | 7.2 | 207 | ≦−10 |
| K-13 | 30 | 10 | 4% DCPD—S | 7.2 | 377 | ≦−10 |
| L-13 | 35 | 15 | 4% DCPD—S | 7.2 | 349 | 13 |
| J-14 | 25 | 5 | 4% DCPD—S | 7.6 | 284 | ≦−10 |
| K-14 | 30 | 10 | 4% DCPD—S | 7.6 | 335 | ≦−10 |
| L-14 | 35 | 15 | 4% DCPD—S | 7.6 | 309 | 24 |
| J-15 | 25 | 5 | 4% SXS | — | 140 | ≦−10 |
| K-15 | 30 | 10 | 4% SXS | — | 377 | ≦−10 |
| L-15 | 35 | 15 | 4% SXS | — | 382 | 8 |

The principle of the invention and the best mode contemplated for applying that principle have been described. It is to be understood that the foregoing is illustrative only and that other means and techniques can be employed without departing from the true scope of the invention defined in the following claims.

What is claimed is:

1. A highly concentrated liquid detergent composition comprising:

(a) about 25 wt. % to about 50 wt. % of a surface active agent comprising:

(i) a nonionic surfactant in the amount of about 20 wt. % to about 40 wt. %, and (ii) an anionic surfactant in the amount of about 0 wt. % to about 20 wt. %;

(b) about 0 wt. % to about 10 wt. % of a solvent selected from the group consisting of ethanol, isopropanol and mixtures thereof;

(c) a hydrotrope selected from the group consisting of the ammonium, sodium, potassium, calcium and magnesium salts of dicyclopentadiene sulfonate in an amount sufficient to give the highly liquid detergent a kinematic viscosity of from 50 to 500 cs at 25° C.; and (d) water.

2. The composition of claim 1 wherein the surface active agent is in an amount of 35 wt. % to 45 wt. %.

3. The composition of claim 1 wherein the nonionic surfactant is in an amount of 25 wt. % to 35 wt. % and the anionic surfactant is in an amount of 5 wt. % to 15 wt. %.

4. The composition of claim 1 wherein the solvent is in an amount of 2 wt. % to 6 wt. %.

5. The composition of claim 1 wherein the solvent is ethanol.

6. The composition of claim 1 wherein the kinematic viscosity is from 100 to 250 cs.

7. A dilute liquid detergent composition comprising:

A. about 0.01 vol. % to about 50 vol. % of a concentrated liquid detergent formulation comprising:

(a) about 25 wt. % to about 50 wt. % of a surface active agent comprising:

(i) a nonionic surfactant and (ii) an anionic surfactant wherein the weight ratio of anionic: nonionic is 0:1 to 2:1;

(b) about 0 wt. % to about 10 wt. % of a solvent selected from the group consisting of ethanol, isopropanol and mixtures thereof;

(c) a hydrotrope selected from the group consisting of the ammonium, sodium, potassium, calcium and magnesium salts of dicyclopentadiene sulfonate in an amount of from 1 wt. % to 6 wt. %; and B. water.

8. The composition of claim 7 wherein A the amount of concentrated liquid detergent formulation is from about 0.05 vol. % to about 0.5 vol. %.

9. The composition of claim 7 wherein the amount of solvent is from 2 to 6 wt. %.

10. The composition of claim 1 wherein the nonionic surfactant is the 8.5 molar ethoxylate of nonylphenol in a 6:1 (wt:wt) blend with triethanolamine in an amount of about 30 to 35 wt. %; the anionic is sodium dodecylbenzene sulfonate in an amount of about 10 to 15 wt. %; the solvent is ethanol in an amount of about 4 wt. % and the hydrotrope is the sodium salt of dicyclopentadiene sulfonate formed by bisulfite addition to dicyclopentadiene in alcohol/water solution at a pH of about 6.0 and in an amount of about 2 wt. %.

11. The composition of claim 10 wherein the nonionic surfactant is in an amount of about 30 wt. % and the anionic surfactant is in an amount of about 10 wt. %.

12. The composition of claim 10 wherein the nonionic surfactant is in an amount of about 35 wt. % and the anionic surfactant is in an amount of about 15 wt. %.

13. The composition of claim 1 wherein the nonionic surfactant is the 8.5 molar ethoxylate of nonylphenol in a 6:1 (wt:wt) blend with triethanolamine in an amount of about 25 wt. %; the anionic surfactant is sodium dodecylbenzene sulfonate in an amount of about 5 wt. %; the solvent is ethanol in an amount of about 4 wt. % and the hydrotrope is the sodium salt of dicyclopentadiene sulfonate formed by bisulfite addition to dicyclopentadiene in alcohol/water solution at a pH of about 7.2 and in an amount of about 2 wt. %.

* * * * *